US012807276B2

(12) United States Patent
Carr

(10) Patent No.: US 12,807,276 B2
(45) Date of Patent: Nov. 24, 2026

(54) INFLATABLE VESSEL

(71) Applicant: Tugdock Submersible Platforms Limited, Cheltenham (GB)

(72) Inventor: Shane Carr, Falmouth (GB)

(73) Assignee: Tugdock Submersible Platforms Limited, Cheltenham (GB)

( * ) Notice: Subject to any disclaimer, the term of this patent is extended or adjusted under 35 U.S.C. 154(b) by 569 days.

(21) Appl. No.: 18/007,044

(22) PCT Filed: Jul. 26, 2021

(86) PCT No.: PCT/GB2021/051919
§ 371 (c)(1),
(2) Date: Jan. 26, 2023

(87) PCT Pub. No.: WO2022/023722
PCT Pub. Date: Feb. 3, 2022

(65) Prior Publication Data

US 2023/0286615 A1 Sep. 14, 2023

(30) Foreign Application Priority Data

Jul. 27, 2020 (GB) ..... 2011626

(51) Int. Cl.

| | |
|---|---|
| ***B63B 35/34*** | (2006.01) |
| ***B63B 7/08*** | (2020.01) |
| ***B63B 35/38*** | (2006.01) |
| ***B63C 1/02*** | (2006.01) |

(52) U.S. Cl.
CPC ..... *B63B 7/082* (2013.01); *B63B 35/34* (2013.01); *B63C 1/02* (2013.01); *B63B 35/38* (2013.01)

(58) Field of Classification Search
CPC ..... B63B 7/00; B63B 7/082; B63B 7/08; B63B 35/00; B63B 35/34; B63B 35/38; B63C 1/00; B63C 1/02
USPC ..... 114/45; 405/219
See application file for complete search history.

(56) References Cited

U.S. PATENT DOCUMENTS

| | | | | |
|---|---|---|---|---|
| 2,677,406 | A | 5/1954 | Morgan | |
| 2,795,257 | A | 6/1957 | Cunningham | |
| 3,774,812 | A | 11/1973 | Lemelson | |
| 2006/0153643 | A1 * | 7/2006 | Basta | B63C 1/02 405/219 |

FOREIGN PATENT DOCUMENTS

| | | | |
|---|---|---|---|
| EP | 0502219 | A1 | 9/1992 |
| EP | 1186528 | A1 | 3/2002 |
| GB | 783407 | A | 9/1957 |
| GB | 2570453 | B | 7/2020 |
| GB | 2597529 | A | 2/2022 |
| WO | 9927330 | A1 | 6/1999 |

* cited by examiner

*Primary Examiner* — Lars A Olson
(74) *Attorney, Agent, or Firm* — Saunders McKeon PLLC

(57) ABSTRACT

An inflatable vessel is provided, the vessel comprising an enclosed flexible membrane having an interior, a first end and a second end; and a rigid elongate member extending within the interior of the membrane and attached to the membrane at a first attachment point at the first end of the membrane and to the membrane at a second attachment point at the second end of the membrane. The vessel finds use, for example, in a floating dry dock assembly.

19 Claims, 13 Drawing Sheets

INFLATABLE VESSEL

The present invention relates to an inflatable vessel. The inflatable vessel finds use, for example, in a floating assembly, such as a floating deck assembly. Floating assemblies according to the present invention can be employed as floating dry docks. The inflatable vessel according to the present invention finds an alternative use as a water bag.

GB783407 A and U.S. Pat. No. 2,795,257 A disclose collapsible containers for liquids according to the prior art.

WO99/27330 A1 discloses a load creation apparatus in the form of a liquid filled container with a suspension means for suspending the container from a load, according to the prior art.

Floating deck assemblies are known and have previously been used in a wide range of applications. For example, air bags supporting a deck have been used for many years for bridging rivers and swamps, or as pontoons for mooring boats.

More recently, floating deck assemblies have found use as floating dry docks.

GB2570453 A discloses a floating deck assembly according to the prior art. The deck assembly includes a first support assembly, a deck, a plurality of support members extending between and connecting the first support assembly and the deck, and a plurality of inflatable vessels disposed between the first support assembly and the deck.

The assembly disclosed in GB2570453 A may also be used as a floating dry dock, including raising a vessel or other floating structure from the water and returning the vessel to the water. In use, the inflatable vessels are inflated to a level to allow the deck assembly to be submerged below a vessel in the water. In particular, with the assembly floating, one or more of the inflatable vessels are deflated partially or wholly by an amount required to sink the assembly to have the deck at the appropriate depth under the surface of the water. The assembly is then manoeuvred beneath the vessel or structure to be raised or the vessel or structure is manoeuvred over the deck of the deck assembly. The inflatable vessels are then inflated, raising the deck assembly until the hull of the vessel is in contact with the deck. Continued inflation of the inflatable vessels raises the vessel from the water. The reverse procedure is followed to return the vessel to the water.

Suitable inflatable vessels are known in the art and are commercially available. Suitable inflatable vessels include inflatable bags. One preferred inflatable vessel is the range of cylindrical Seaflex® inflatable bags available from the Unique Group.

Inflatable bags according to the prior art typically include a flexible membrane of material with a flexible internal connecting strop extending between attachment points in the membrane at opposite ends of the bag. When the bag is inflated, the internal connecting strop provides a tensile force between the attachment points to prevent the vessel from distending under internal pressure. In this way, the internal connecting strop helps to maintain the form of the vessel when inflated.

Inflatable bags according to the prior art can be connected to structures that are submerged or partially submerged in a body of water. The connection is made via a shackle located on the external surface of the flexible membrane at one of the attachment points, positioned at the bottom of the bag, in use.

The internal connecting strop is orientated generally vertically, in use. The buoyancy of the inflatable bag is transferred via tension in the internal connecting strop to the shackle positioned at the bottom of the bag, to provide a lifting force to the submerged or partially submerged structure connected to the shackle.

However, this creates particular challenges when inflatable bags according to the prior art are used to provide buoyancy to a floating deck assembly, in which a portion of the structure, including the deck, is designed to breach the water surface. In particular, the inflatable bags cannot be connected above the deck, as they would be unable to provide the buoyancy required to lift the deck clear of the water surface, when inflated. This necessitates the inclusion of an additional support assembly, connected to the deck via a plurality of support members extending between the support assembly and the deck, to which the inflatable bags can be connected whilst remaining wholly or partially submerged, even when the deck breaches the water surface. The inflatable bags are disposed between the support assembly and the deck and are each connected to the support assembly via the shackle positioned at the bottom of the bag, in use. The buoyant lifting force of each inflated bag is transferred as tension in the internal connecting strop to the support assembly via the shackle. The support assembly, in turn, transfers the buoyant lifting force to the deck via the plurality of support members. The support assembly of floating deck assemblies according to the prior art therefore needs be sufficiently strong to withstand the buoyant lifting force of each inflatable bag, as well as the weight of the deck and support members above.

In order to achieve the necessary strength and rigidity, the support assemblies used in floating deck assemblies according to the prior art are heavy and have a deep draught. It would be advantageous to reduce the weight and draught of floating deck assemblies, such as those described in GB2570453 A, so that they can operate in shallower water and accommodate larger and/or heavier vessels.

There is therefore a need for an improved inflatable bag for use in floating assemblies, such as floating deck assemblies.

Accordingly, a first aspect of the present invention provides an inflatable vessel comprising:

- an enclosed flexible membrane having an interior, a first end and a second end; and
- a rigid elongate member extending within the interior of the membrane and attached to the membrane at a first attachment point at the first end of the membrane and to the membrane at a second attachment point at the second end of the membrane.

The inflatable vessel of the present invention comprises an enclosed flexible membrane. The membrane has an interior therein. The enclosed flexible membrane is closed off on all sides to define a substantially airtight and/or watertight interior.

The flexible membrane may be formed from any suitable material. Suitable materials are known in the art and are commercially available. The membrane should be formed from a material strong enough to withstand the pressure differential arising between the interior of the membrane and the exterior, when the vessel is in use. Suitable materials include, but are not limited to, polymeric materials, for example polyesters. The material is preferably coated, for example with polyvinylchloride or polyurethane. One example of a suitable material is High Tensile Trevira® Polyester base cloth coated with a heavy duty UV stabilised PVC or polyurethane coating.

The material may be porous. More preferably, the material is non-porous.

In use, the interior of the flexible membrane is filled with a fluid to inflate the vessel. The fluid may be a gas, a mixture of gases, a liquid, a mixture of liquids, or a mixture of one or more gases and one or more liquids. In a preferred embodiment, the fluid is air. In an alternative embodiment, the fluid is water.

When the vessel is inflated, the enclosed flexible membrane may assume any suitable shape. For example, the membrane may be spherical, ovoid, cuboidal, or irregular in shape, when inflated. The vessel may have a constant cross-sectional area along its length from the first end to the second end, when inflated. This has the advantage that the vessel can be arranged to provide a constant water plane area, when partially submerged and rising or falling relative to the surface of the water. Alternatively, the cross-sectional area of the vessel may vary along its length from the first end to the second end. For example, when inflated, the vessel may be tapered along a part or all of its length from the first end to the second end.

In a preferred embodiment, the membrane assumes a substantially cylindrical shape when inflated. The ends of the cylinder may be substantially flat or may be rounded, when the vessel is inflated to its working pressure. Where the membrane assumes a substantially cylindrical shape when inflated, the first and second attachment points are preferably located at respective first and second ends of the cylindrical membrane.

When the vessel is inflated, the enclosed flexible membrane defines an interior volume. The maximum interior volume of the flexible membrane will depend upon the shape and dimensions of the membrane, when fully inflated. The maximum interior volume of the vessel may vary according to the intended use or duty of the vessel. For example, in the case of a vessel intended for use underwater to provide buoyancy, the volume of the interior will be determined by the volume of water to be displaced by the vessel and, hence the buoyancy to be provided.

Generally, the maximum interior volume of the flexible membrane is from 1 $m^3$ to 250 $m^3$, preferably from 5 $m^3$ to 100 $m^3$, still more preferably from 10 $m^3$ to 25 $m^3$.

The material of the flexible membrane may have any suitable thickness. For example, the thickness of the membrane may be selected based on the material used to form the membrane, the dimensions of the inflatable vessel and the volume of fluid it must contain, in use. Alternatively or additionally, the thickness of the membrane may be selected based on the maximum pressure it must withstand, when inflated.

The thickness of the flexible membrane may be uniform across the entire outer surface of the vessel. Alternatively, the thickness of the flexible membrane may be non-uniform. In particular, the membrane may be thicker at stress points to provide reinforcement, for example to resist splits or tears. For example, the membrane may be thicker at the first and second attachment points. Where the membrane, when inflated, assumes a shape having corners and/or edges, such as a cuboid, the membrane may be thicker at the said corners and/or edges. The membrane may also be thicker in regions of the outer surface that may be subject to wear or abrasion.

A greater thickness may be achieved, for example, by laminating one or more layers of the material forming the flexible membrane.

The vessel of the present invention further comprises an elongate member. The elongate member is rigid and extends between the first end and the second ends of the membrane of the vessel. The rigid elongate member fulfils a structural role when the vessel is inflated.

In particular, the rigid elongate member provides a restraining force between the first and second attachment points to restrain relative movement of the first and second ends of the inflatable vessel. The restraining force may be a tensile or compressive force.

For example, the rigid elongate member prevents the first and second ends of the inflatable vessel bowing outwards or distending due to internal pressure when the vessel is inflated. In doing so, the rigid elongate member is placed in tension.

The rigid elongate member, by being rigid, also provides a resistance to compressive forces, in particular forces acting from one of the first or second ends towards the other of the first and second ends, thereby preventing the vessel from deforming under the action of external forces applied at or near the first and second attachment points. In doing so, the rigid elongate member is placed in compression.

The rigid elongate member may be formed from any suitable material. The material of the rigid elongate member is preferably selected to withstand the maximum tensile and compressive forces that may be experienced by the rigid elongate member, in use. Suitable materials for forming the rigid elongate member include metals, metal alloys, polymers, or composite materials. In a preferred embodiment, the rigid elongate member is formed from a metal, with steel being one preferred material.

The rigid elongate member may have any suitable cross-sectional shape, such as circular or polygonal. In one preferred embodiment, the rigid elongate member is circular in cross-section. The rigid elongate member preferably has a uniform cross-sectional area along its length.

The rigid elongate member may be solid, however, preferably at least a portion of the rigid elongate member is hollow. In a particularly preferred embodiment, the rigid elongate member comprises a tube.

The rigid elongate member may be any suitable length. The length of the rigid elongate member generally determines the length of the vessel from the first end to the second end. Generally, the rigid elongate member is from 0.5 m to 15 m in length, preferably from 1 m to 10 m in length, still more preferably from 2 m to 3 m in length.

The rigid elongate member is attached at its ends to the membrane at an attachment point at each of the first and second ends of the membrane. The rigid elongate member may be attached to the flexible membrane at the first and second attachment points by any suitable attachment means. In one preferred embodiment, the rigid elongate member may be attached to the flexible membrane at the first and second attachment points by one or more attachment members, such as a plate, collar or flange. In particular, the rigid elongate member may be provided with a plate, collar or flange at one or both ends.

In one embodiment, the rigid elongate member may be attached to the membrane at the first attachment point by a first attachment member located at or adjacent a first end of the rigid elongate member. The first attachment member may be releasably connected to the rigid elongate member. More preferably, the first attachment member is permanently connected to the rigid elongate member, for example by being bonded to the rigid elongate member, such as by welding, or being formed integrally with the elongate rigid member.

The first attachment member is used to connect the rigid elongate member to the membrane at the first attachment point at the first end. The membrane may be attached to the first attachment member of the rigid elongate member by any suitable means. The attachment means is suitable for preventing the rigid elongate member becoming detached from the membrane at the normal working pressure of the vessel. Suitable attachment means include bonding, such as with a suitable adhesive, threaded connections, such as studs or bolts, and rivets.

The membrane may be reinforced by a reinforcement in the region of the first attachment point. The reinforcement may comprise a region of increased thickness of the membrane.

In one preferred embodiment the reinforcement comprises a first reinforcing member disposed on the inside or the outside of the membrane. In one preferred embodiment, the first reinforcing member is disposed on the outside of the membrane. The first reinforcing member may be in the form of a reinforcing plate or a reinforcing ring. In one preferred embodiment, the first reinforcing member is a reinforcing ring.

The first reinforcing member may be formed from any suitable material. The first reinforcing member may be formed from the same material as the rigid elongate member or a different material. Suitable materials include metals, metal alloys, polymers, or composite materials. In a preferred embodiment, the first reinforcing member is formed from steel.

The material of the flexible membrane in the region of the first attachment point is preferably disposed between a portion of the rigid member, for example the first attachment member and the reinforcing member. In particular, the first reinforcing member is secured to the first attachment member, so that the material of the flexible membrane at the first attachment point is clamped between the reinforcing member and the first attachment member to attach the first end of the rigid elongate member to the membrane.

The first reinforcing member may be attached to the membrane and/or the first attachment member by any suitable means. The material of the flexible membrane may be provided with a plurality of holes at the first attachment point for receiving a plurality of fixings used to secure the first reinforcing member to the first attachment member. Suitable fixings include, but are not limited to, threaded members, such as studs or bolts, and rivets.

The rigid elongate member may be attached to the membrane at the second attachment point by a second attachment member located at or adjacent a second end of the rigid elongate member in an analogous manner to that described above.

As discussed above, the first attachment member and/or the second attachment member may comprise a plate, collar or flange.

Similarly, the membrane may be reinforced by a reinforcement in the region of the second attachment point. The reinforcement may comprise a region of increased thickness of the membrane.

In one preferred embodiment the reinforcement comprises a second reinforcing member disposed on the inside or the outside of the membrane for attachment to the membrane at the second attachment point in an analogous manner to the first reinforcing member described above. The second reinforcing member may be in the form of a reinforcing plate or a reinforcing ring. In one preferred embodiment, the second reinforcing member is a reinforcing ring.

The rigid elongate member may be accommodated entirely within the flexible membrane. Alternatively, one or more portions of the rigid elongate member may extend through and outside the flexible membrane. In some preferred embodiments, an end portion of the rigid elongate member extends through the flexible membrane at the first attachment point and/or the second attachment point.

For example, in one embodiment, the first end of the rigid elongate member may extend through the first attachment member, the material of the flexible membrane at the first attachment point, and the first reinforcing member.

Similarly, the second end of the rigid elongate member may extend through the second attachment member, the material of the flexible membrane at the second attachment point, and the second reinforcing member.

The provision of the vessel with a rigid elongate member extending within the flexible membrane has significant advantages when the inflatable vessel according to the present invention is used to provide buoyancy to an external object or structure.

In particular, the rigid elongate member included in the inflatable vessel according to the present invention is typically orientated generally vertically in use. When the vessel is wholly or partially submerged, the rigid elongate member can transfer the forces generated as a result of the buoyancy of the inflatable vessel to one or both of the first and second attachment points at the first and second ends of the membrane.

Specifically, when the rigid elongate member is orientated generally vertically, for example with the first attachment point positioned at the top of the vessel, in use, the buoyancy of the inflatable vessel is transmitted via the rigid elongate member to the first attachment point. The rigid elongate member is thus subjected to compressive forces as the buoyancy of the vessel pushes against the weight of an object or structure connected to the first attachment point.

Similarly, when the rigid elongate member is orientated generally vertically, for example with the second attachment point positioned at the bottom of the vessel, in use, the buoyancy of the inflatable vessel is transmitted via the rigid elongate member to the second attachment point. The rigid elongate member is thus subjected to tensile forces as the buoyancy of the vessel pulls against the weight of an object or structure connected to the second attachment point.

Thus, the inclusion of the rigid elongate member in the inflatable vessel according to the present invention allows the inflatable vessel to transmit a buoyant lifting force to an external structure via one or both of the first and second attachment points. This is particularly beneficial as it allows the inflatable vessel to be connected to external structures in a variety of configurations not permitted by prior art inflatable bags.

For example, the inflatable vessel could be connected to an external structure at one of the first or second attachment points positioned at the top of the vessel, in use, to provide a buoyant lifting force to a structure positioned generally above the vessel. Alternatively, the inflatable vessel could be connected to an external structure at one of the first or second attachment points positioned at the bottom of the vessel, in use, to provide a buoyant lifting force to a structure positioned generally below the vessel.

The inflatable vessel may be connected to an external structure at both the first and second attachment points. This has the further advantage of transmitting the buoyancy of the vessel through both attachment points simultaneously, thus reducing the magnitude of the buoyant lifting force transmitted through each of the first and second attachment points individually. This, in turn, reduces the risk of failure of the flexible membrane at or near the attachment points.

The inflatable vessel according to the present invention may be connected to an object or structure at either end of the membrane, with the connections being made directly or indirectly to the respective end of the rigid elongate member. In one embodiment, the inflatable vessel includes one or more connectors located at one or both of the first and second attachment points for connecting the inflatable vessel to an external structure. The one or more connectors may comprise any suitable components for permanently or releasably connecting the vessel to an object or a structure. The one or more connectors may comprise a connector flange for connecting to an object or a structure.

In one embodiment, the rigid elongate member extends through the first attachment point and the membrane at its first end, as described above, and the connector flange is located on a portion of the first end of the rigid elongate member extending beyond the first attachment point outside the membrane. The connector flange may be used to affix the inflatable vessel to the object or structure, for example using a releasable fastening, such as bolts, or a permanent fastening, such as rivets, inserted through holes in the connector flange.

In one embodiment, the connector comprises an open-ended connector tube. The connector tube may be provided by an end portion of the rigid elongate member extending outside of the membrane. Alternatively, the connector tube may be connected directly or indirectly to the rigid elongate member, for example by way of one or more flanges. In use, the open end portion of the connector tube may be engaged with a corresponding spigot provided on the object or structure, which serves to locate the vessel relative to the object or structure and allow the connector tube to be connected to the spigot, for example by one or more bolts, pins or the like.

The connector may comprise a buffer to accommodate small relative movements between the inflatable vessel and the object or structure, when connected. The buffer may be formed from a resilient material, such as natural or synthetic rubber or other resilient polymers. The buffer may have any suitable form. For example, the buffer may be an O-ring.

The vessel may be provided with one or more connectors at just one end. Alternatively, the vessel may be provided with one or more connectors at each end.

In a preferred embodiment, the connectors comprises one or more anchors for connecting to a tensioned wire.

The inflatable vessel according to the present invention is preferably provided with a fluid port. The fluid port may be used to inflate or deflate the vessel by pumping a fluid in to or out of the interior of the flexible membrane via the fluid port. For example, the fluid port may be connected, in use, to a compressor and/or a pump via a manifold, to provide fluid to or remove fluid from the interior of the membrane.

The fluid port may be located in the flexible membrane. However, in a preferred embodiment, the rigid elongate member further comprises the fluid port and the rigid elongate member comprises a fluid conduit for fluid to pass between the fluid port and the interior of the membrane. In one embodiment, at least a portion of the rigid elongate member is hollow, the hollow portion providing a conduit for the flow of fluid. In one preferred embodiment, the rigid elongate member comprises a tube, with the tube providing the conduit for the flow of fluid and having one or more openings therein to allow fluid to enter or leave the interior of the membrane. One or both of the first and second ends of the rigid elongate member may be provided with a fluid port.

The inflatable vessel is preferably provided with a pressure relief system to allow excess fluid pressure within the vessel to be vented. Excess fluid pressure within the vessel may be caused by over-inflation, changes in ambient temperature, or a reduction in hydrostatic pressure as the vessel rises through a water column. Preferably, the pressure relief system includes a pressure relief valve, such as a blow-off valve. Suitable valves are known in the art and are commercially available.

The pressure relief valve may be provided in the flexible membrane. However, in a preferred embodiment, the pressure relief valve is provided in the rigid elongate member. For example, a pressure relief valve may be located in the first and/or second end of the rigid elongate member. In this arrangement, the rigid elongate member comprises a conduit for taking fluid from the interior of the membrane to the pressure relief valve. This conduit may be the same conduit as discussed above for the supply of fluid to or removal of fluid from the interior of the vessel. Alternatively, the rigid elongate member may be provided with a separate pressure relief conduit.

The inclusion of a fluid port and/or pressure release valve in the rigid elongate member reduces or eliminates the need to locate such components in the flexible membrane, as in prior art inflatable bags. This reduces the complexity of the flexible membrane. This both simplifies the process of manufacturing the flexible membrane, and reduces the likelihood of leaks forming at the structural weak points created by insertion of the fluid port and/or pressure relief valve through the membrane.

The rigid elongate member may further comprise one or more outlet tubes for emitting fluid from the rigid elongate member beyond the first and/or second attachment point and the membrane. In particular, the one or more outlet tubes may be located at the bottom of the inflatable vessel, in use. Fluid may therefore be emitted from the rigid elongate member from the bottom of the inflatable vessel through the one or more outlet tubes. The fluid emitted may be used to clear sediment from the sea, river or lake bed directly below the inflatable vessel. This can increase the depth of water below the inflatable vessel, and increase the depth to which the inflatable vessel can be submerged.

Inflatable vessels according to the present invention find particular use in floating assemblies, such as floating deck assemblies.

Accordingly, a further aspect of the present invention provides a floating assembly comprising at least one inflatable vessel as hereinbefore described.

In a further aspect, the present invention provides a floating assembly, the assembly comprising:

- a first frame assembly;
- a second frame assembly;
- a plurality of support members extending between and connecting the first frame assembly and the second frame assembly; and
- a plurality of inflatable vessels according to the first aspect of the present invention disposed between the first frame assembly and the second frame assembly.

Generally, the first frame assembly is located above the plurality of inflatable vessels, in use, while the second frame assembly is located below the plurality of inflatable vessels in use.

Each inflatable vessel may be connected to the first frame assembly at the first attachment point for transferring the buoyancy of the inflatable vessel to the first frame assembly and/or to the second frame assembly at the second attachment point for transferring the buoyancy of the inflatable vessel to the second frame assembly.

Preferably, each inflatable vessel is connected to both the first and second frame assembly such that, in use, the buoyancy of each vessel is transferred by compression in the rigid elongate member to the first frame assembly and by tension in the rigid elongate member to the second frame assembly.

This is advantageous as the buoyancy of the plurality of inflatable vessels is spread over both the first and second frame assemblies, thus reducing the loading requirement on any one of the first and second frame assemblies.

The floating assembly according to the present invention can be employed in a floating deck assembly, wherein the floating deck assembly further comprises one or more deck panels forming a deck connected to the first frame assembly.

The ability to transfer all, or a component of, the buoyancy of each inflatable vessel directly to the first frame assembly located above the inflatable vessels, in use, reduces or eliminates the need to include a support assembly below the inflatable vessels capable of withstanding the forces arising from the total combined buoyancy of each inflatable vessel, as well as the weight of the deck and support members, as in prior art floating deck assemblies. Thus, the total weight and draught of floating deck assemblies can be reduced by employing inflatable vessels according to the present invention. This is particularly advantageous when the floating deck assembly according to the present invention is employed as a floating dry dock.

In a further aspect, the present invention provides a floating dry dock comprising a floating deck assembly as hereinbefore described.

When used as a floating dry dock, one or more of the inflatable vessels may be wholly or partially deflated to a level to allow the deck assembly to be submerged below a vessel or structure in the water. In particular, the one or more vessels are preferably deflated by an amount required to sink the floating deck assembly to an appropriate depth under the surface of the water. The assembly is then manoeuvred beneath the vessel or structure to be raised or the vessel or structure is manoeuvred over the deck of the deck assembly. The inflatable vessels are then inflated, raising the floating deck assembly until the hull of the vessel is in contact with the deck. Continued inflation of the inflatable vessels raises the vessel from the water. The reverse procedure is followed to return the vessel to the water.

Accordingly, a further aspect of the present invention provides a method for raising a vessel or structure from water, the method comprising:

- providing a floating dry dock as hereinbefore described;
- sinking the floating dry dock below the vessel or structure to be raised;
- manoeuvring the floating dry dock below the vessel or structure to be raised; and
- raising the floating dry dock and the vessel or structure to be raised.

The method may further comprise the steps of:

- deflating one or more of the inflatable vessels to sink the floating dry dock below the vessel or structure to be raised; and
- inflating one or more of the inflatable vessels to raise the floating dry dock and the vessel or structure to be raised.

The reduced draught of the floating deck assembly employing inflatable vessels according to the present invention allows it to be sunk to greater depths to accommodate larger vessels or permits use in shallower water than prior art assemblies.

Additionally, the reduced weight of the floating deck assembly employing inflatable vessels according to the present invention allows it to lift heavier vessels when compared to prior art assemblies employing inflatable bags with the same total buoyancy.

In a particularly preferred embodiment, the buoyant lifting force of each inflatable vessel is transferred entirely by compressive forces in the rigid elongate member to the assembly and/or deck positioned above the inflatable vessels in use.

In such embodiments, it may still be preferable to connect the second attachment point, positioned at the bottom of each inflatable vessel, in use, to a portion of the assembly below the inflatable vessel to stabilize the inflatable vessels. However, this connection preferably does not convey any substantial lifting force to the assembly. This connection may be effected, for example, by one or more tensioned wires.

The inflatable vessel of the present invention allows fora floating deck to be provided using very few or a minimum of structural components. In a further preferred aspect of the present invention, the first and second frame assemblies, and the plurality of support members of the floating assembly described above may be omitted entirely.

Thus, in a further aspect, the present invention provides a floating deck unit comprising an inflatable vessel as hereinbefore described; and

- a deck panel connected to the first attachment point of the inflatable vessel.

Two or more floating deck units according to the present invention can be tethered together in a modular arrangement to form a floating deck assembly.

Accordingly, a further aspect of the present invention provides a floating deck assembly comprising two or more floating deck units.

The floating deck assembly may be employed in a floating dry dock.

In one embodiment of the modular arrangement, the first attachment point of each inflatable vessel is connected to a respective deck panel and the second attachment point of each inflatable vessel is tethered to the second attachment point of one or more adjacent inflatable vessels to form a floating deck assembly. The tethers may be rigid or flexible.

While the inflatable vessel according to the present invention finds use in floating deck assemblies, it also has significant advantages in alternative applications.

In one embodiment the inflatable vessel according the present invention can be utilised as a container for fluids, including liquids. In one application, the vessel finds use as a water bag. Water bags are commonly used in the construction and engineering industries to weight test bridges, walkways, pontoons and other load bearing structures. This has previously been achieved using large flexible bags with no structural reinforcement. These bags therefore sag under the weight of the water contained within so that they occupy a large surface area relative to their height. Furthermore, water bags according to the prior art must be manufactured using thick and heavy membrane materials capable of containing a large quantity of water unassisted and without splitting.

The inflatable vessels according to the present invention can be utilised as improved water bags for weight testing structures. In particular, when the inflatable vessels according to the present invention are filled with water or other liquids, they experience an internal pressure due to gravity that is approximately equivalent to the internal pressure due to buoyancy when used underwater.

However, rather than sagging like water bags according to the prior art, the inflatable vessels according to the present invention maintain their structure due to the compressive strength of the rigid elongate member. Therefore the surface area occupied by the inflatable vessel is small compared to its height. This allows a greater weight of water to be loaded per unit area, thereby increasing the test load capacity.

The inclusion of a rigid elongate membrane also permits the use of a thinner and lighter flexible membrane material when compared to prior art water bags. In particular, the rigid elongate member provides additional structural support when the inflatable vessel is filled with a liquid, thereby reducing the load bearing requirements of the flexible membrane when compared to prior art water bags.

Accordingly, a further aspect of the present invention provides a method for weight testing a structure, the method comprising:

disposing an inflatable vessel as hereinbefore described on the structure to be tested; and inflating the inflatable vessel with a liquid.

Embodiments of the present invention will now be described, by way of example only, having reference to the accompanying drawings, in which.

Figure 1:
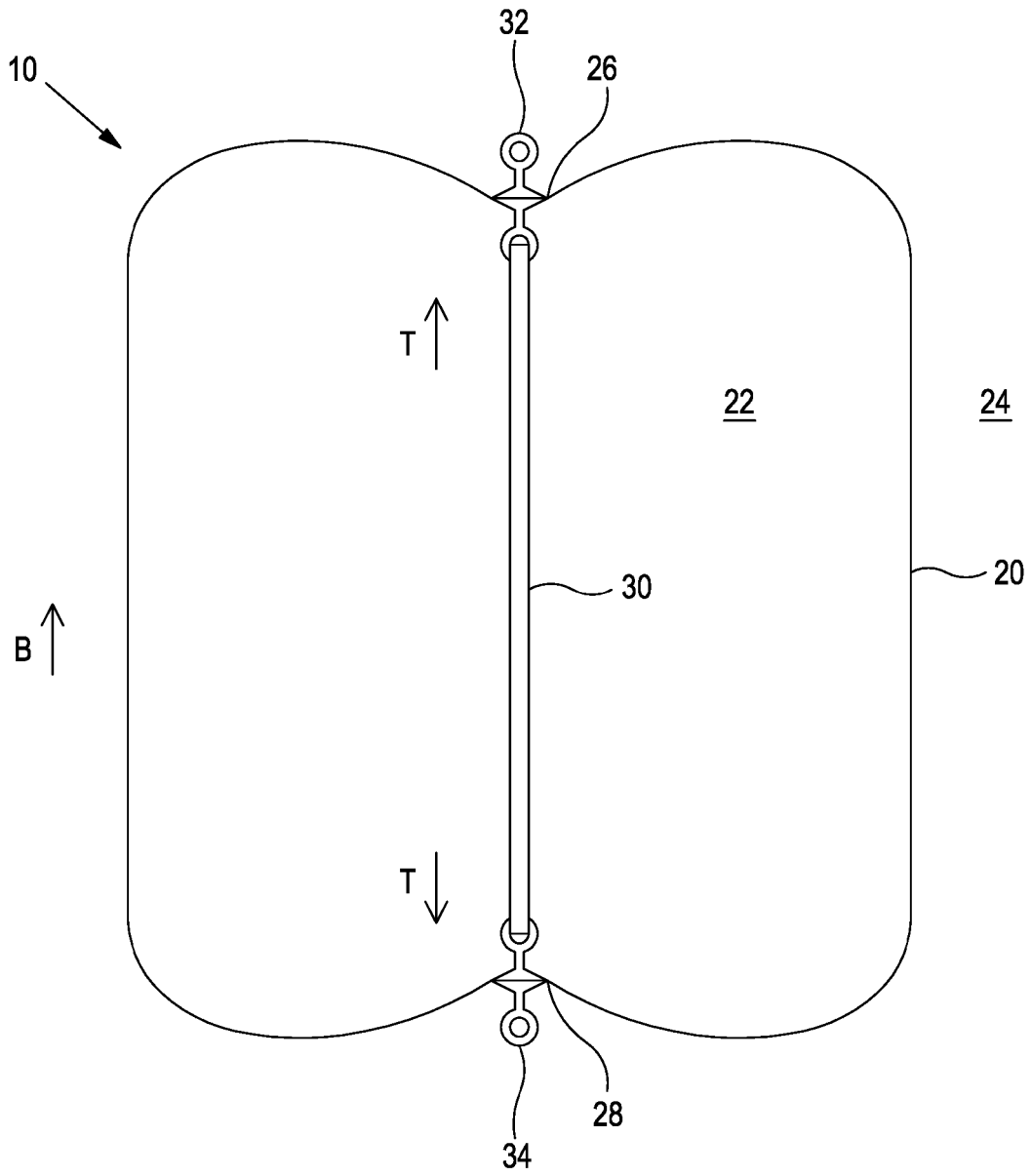
Figure 1 (Prior Art)
FIG. 1 is a cross-sectional view of an inflatable bag of the prior art.

FIG. 1 is a cross-sectional view of an inflatable bag, indicated generally at 10, according to the prior art. The inflatable bag includes a flexible membrane 20. The flexible membrane is enclosed to define an interior 22 and an exterior 24.

A flexible internal connecting strop 30 extends within the interior of the flexible membrane 20 between a first attachment point 26 and a second attachment point 28 in the membrane 20 at opposite ends of the inflatable bag. The flexible internal connecting strop 30 is subjected to tensile forces T between the first and second attachment points 26, 28 when the vessel is inflated. Tension in the connecting strop between the first and second attachment points prevents the vessel from distending under internal pressure, when inflated.

A first shackle 32 is connected to the flexible internal connecting strop 30 at the first attachment point 26. A second shackle 34 is connected to the flexible internal connecting strop 30 at the second attachment point 28. The shackles 32, 34 can be used to connect the inflatable bag to a submerged, or partially submerged, external structure.

The flexible internal connecting strop 30 is orientated generally vertically, in use. When the inflatable bag 10 is submerged, tension in the flexible internal connecting strop 30 transfers the forces generated as a result of the buoyancy B of the inflatable vessel to the second shackle 34 at the second attachment point 28, located on the bottom of the vessel, in use. The buoyancy B of the inflatable bag can therefore be used to pull and lift submerged external structures connected to the second shackle 34, in use.

Figure 2:
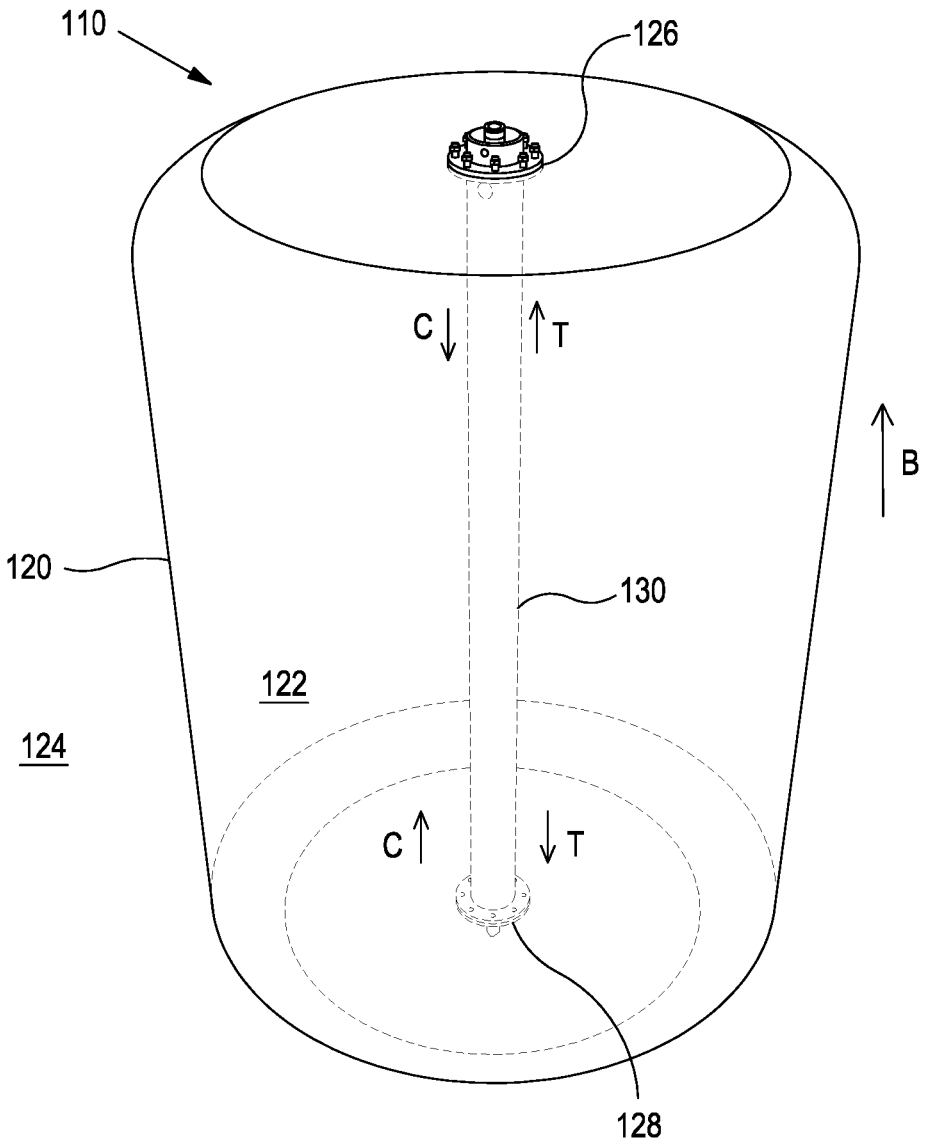
FIG. 2 is a perspective view of an inflatable vessel according to one embodiment of the present invention, viewed from above and one side.
Figure 3:
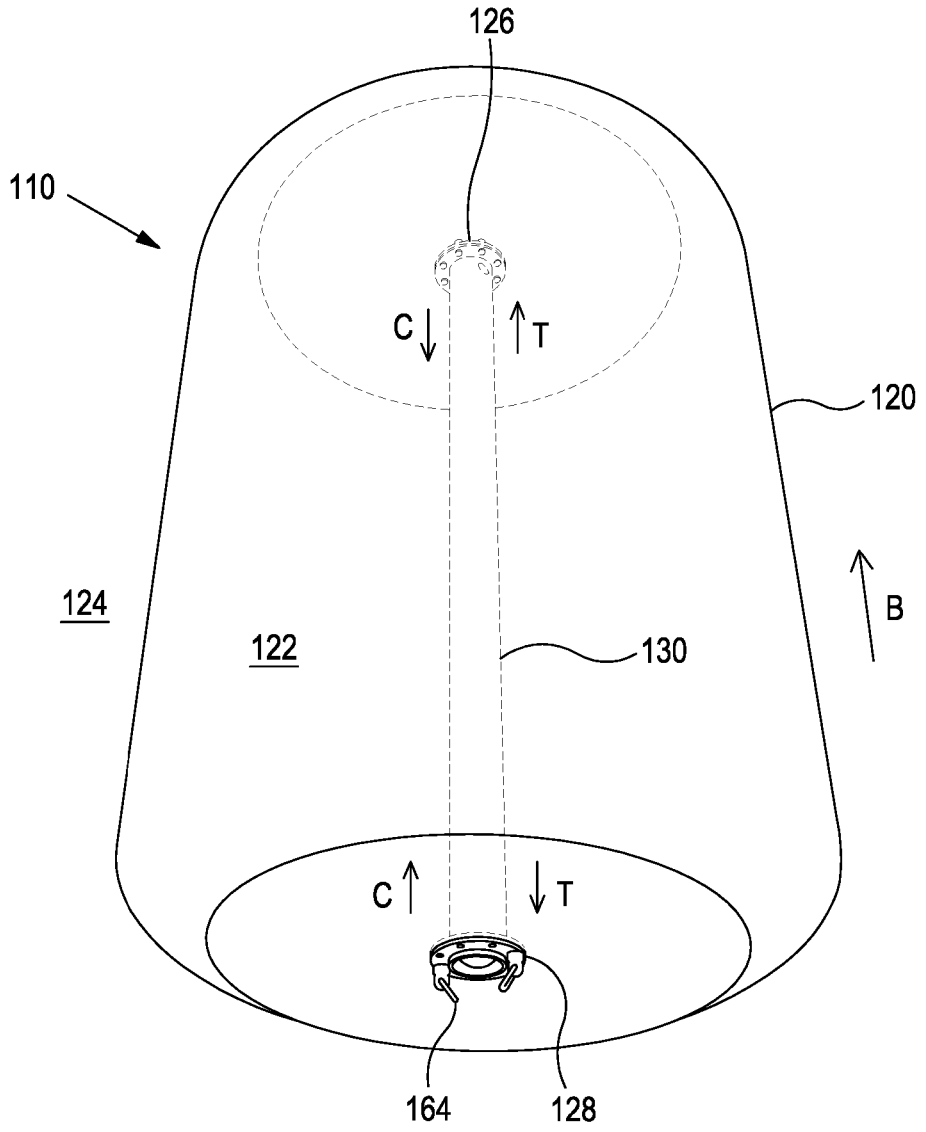
FIG. 3 is a perspective view of the inflatable vessel of FIG. 2, viewed from below and one side.
Figure 4:
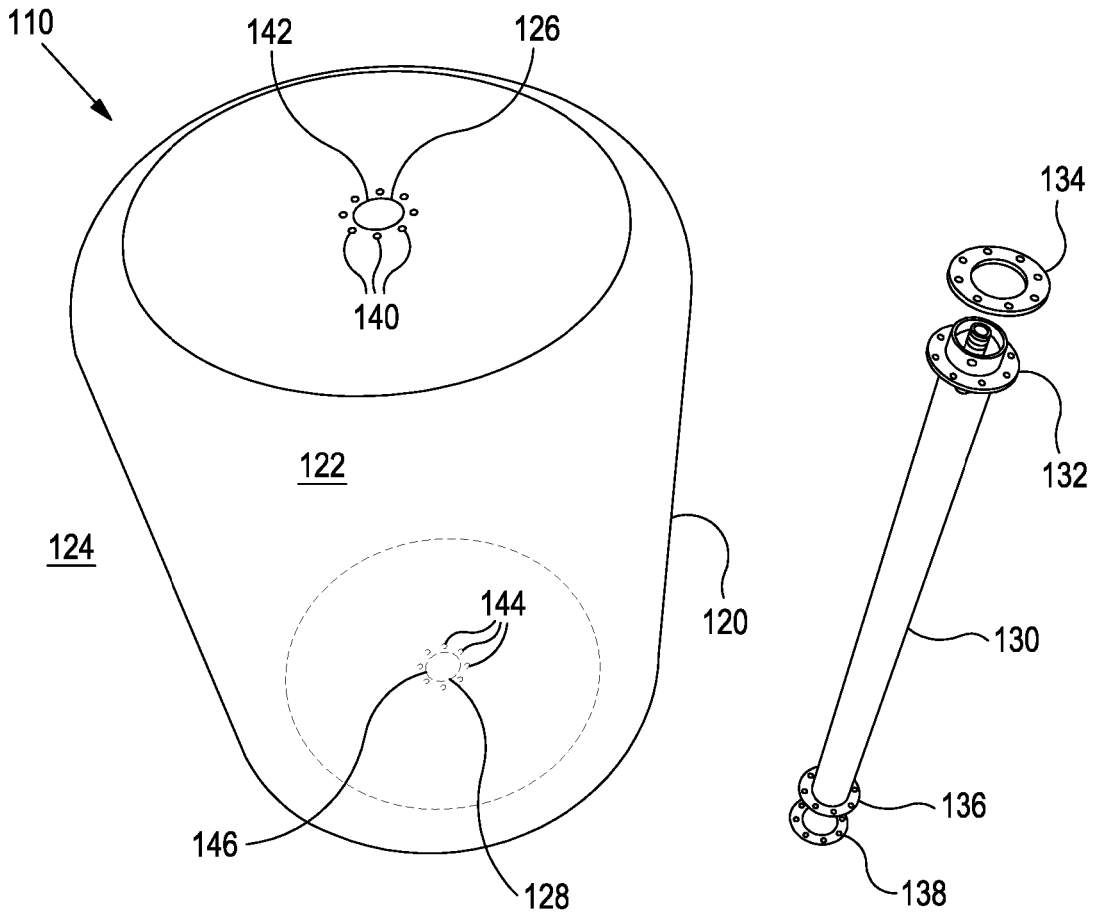
FIG. 4 is an exploded view of the components of the vessel of FIG. 2 in a disassembled state.

Turning to FIG. 2 there is shown a perspective view from above and one side of an inflatable vessel according to one embodiment of the present invention, indicated generally as 110. The vessel 110 is shown in a perspective view from below and one side in FIG. 3. The components of the vessel 110 are shown in FIG. 4.

The inflatable vessel 110 includes a flexible membrane 120. The flexible membrane is enclosed to define an interior 122 and an exterior 124.

A rigid elongate member 130 extends within the interior of the flexible membrane 120. The rigid elongate member extends between a first attachment point 126 and a second attachment point 128 at respective first and second ends of the membrane.

The rigid elongate member 130 is a hollow, generally cylindrical tube. The rigid elongate member 130 is formed from steel. However, a wide range of alternative materials could be employed, depending on the size of the inflatable vessel 110, and the magnitude of forces that it must withstand, in use.

The rigid elongate member is subjected to a tensile force T between the first and second attachment points 126, 128 when the vessel 110 is inflated. Tension in the rigid elongate member between the first and second attachment points provides a restraining force to prevent the vessel from distending under internal pressure, when inflated.

The rigid elongate member may also be subjected to compressive forces C applied at or near the first and second attachment points 126, 128. Resistance to compression in the rigid elongate member thus provides a restraining force that allows the inflatable vessel to withstand compression, in use. This prevents the vessel from deforming when subjected to external forces.

The rigid elongate member 130 is orientated generally vertically, in use. When the inflatable vessel 110 is submerged, tension in the rigid elongate member 130 transfers the buoyancy B of the inflatable vessel to the second attachment point 128, located on the bottom of the vessel, in use. The buoyancy B of the inflatable vessel can therefore be utilised to pull and lift submerged external structures connected to the second attachment point 128, in use.

Furthermore, when the inflatable vessel 110 is submerged, compressive resistance forces in the rigid elongate member 130 transfer the buoyancy B of the inflatable vessel to the first attachment point 126, located on the top of the vessel, in use. The buoyancy B of the inflatable vessel can therefore be utilised to push and lift submerged external structures connected to the first attachment point 128, in use.

Figure 5:
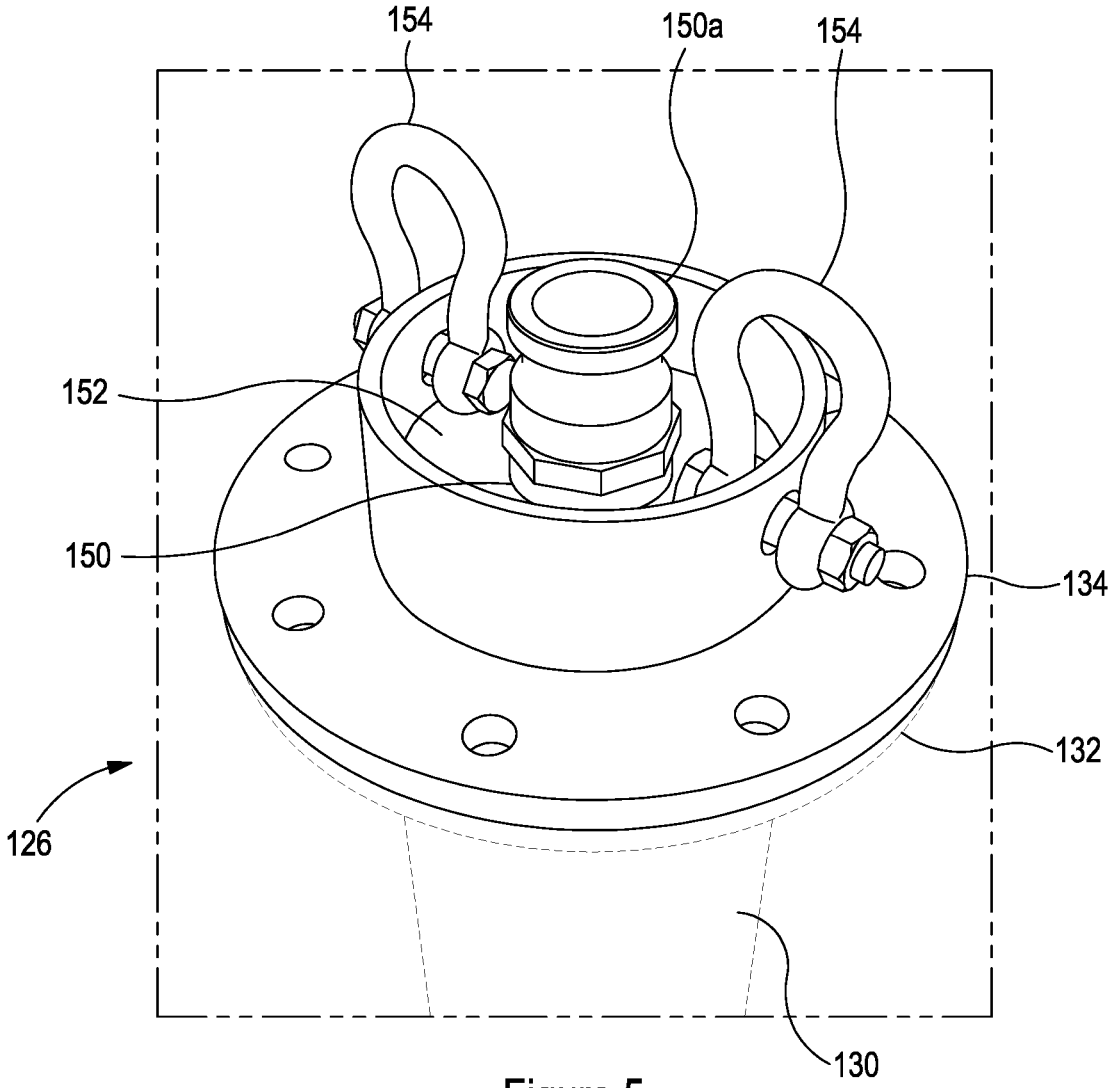
FIG. 5 is an enlarged perspective view of the first attachment point of the vessel of FIG. 2.

Reference is now made to FIGS. 4 and 5. The rigid elongate member 130 includes a first attachment member comprising a first flange 132 located at a first end portion of the rigid elongate member for attachment to the membrane 120 at the first attachment point 126. The first flange 132 is spaced from the end of the rigid member 130. The first flange is fixed to the rigid elongate member by welding.

The vessel is provided with a first reinforcing ring 134 for attachment to the first flange 132 using a plurality of fixings such as bolts (not shown) at the first attachment point 126 of the membrane. When the inflatable vessel 110 is fully assembled, as shown in FIGS. 2 and 3, the material of the flexible membrane 120 at the first attachment point 126 is located between the first flange 132 and the first reinforcing ring 134. In particular, the first reinforcing ring 134 is secured to the first flange 132 such that the intermediate portion of the flexible membrane 120 is clamped between the first reinforcing ring and the first flange to form a water-tight seal. As can be seen in FIG. 4, the flexible membrane 120 includes a first plurality of holes 140 for receiving the plurality of fixings used to attach the first reinforcing ring 134 to the first flange 132.

When the inflatable vessel is fully assembled, as shown in FIG. 2, a portion of the rigid elongate member 130 extends through an aperture 142 in the membrane at the first attachment point 126, as can be seen in more detail in FIG. 5. In particular, the rigid elongate member extends through the first flange 132, the flexible membrane 120 and the first reinforcing ring 134 to project beyond the outer surface of the membrane.

Optional shackles 154 are connected to the end of the rigid elongate member 130, as shown in FIG. 5. These shackles can be used to connect the inflatable vessel to an external structure, or to a lifting device, such as a crane to assist in manoeuvring the inflatable vessel.

Referring again to FIG. 4, the rigid elongate member 130 includes a second attachment member comprising a second flange 136 located at a second end of the rigid elongate member for attachment to the membrane 120 at the second attachment point 128. The second flange is fixed to the end of the rigid elongate member by welding. The vessel comprises at the second attachment point 128 a second reinforcing ring 138 for attachment to the second flange 136 using a plurality of fixings such as bolts (not shown). When the inflatable vessel is fully assembled, as shown in FIGS. 2 and 3, a portion of the material of the flexible membrane 120 at the second attachment point 128 is located between the second flange 136 and the second reinforcing ring 138. In particular, the second reinforcing ring 138 is secured to the second flange 134 such that the portion of the flexible membrane 120 is clamped between the second reinforcing ring and the second flange to form a water-tight seal. As can be seen in FIG. 4, the flexible membrane 120 includes a second plurality of holes 144 at the second attachment point for receiving the plurality of fixings used to attach the second reinforcing ring to the second flange.

Figure 7:
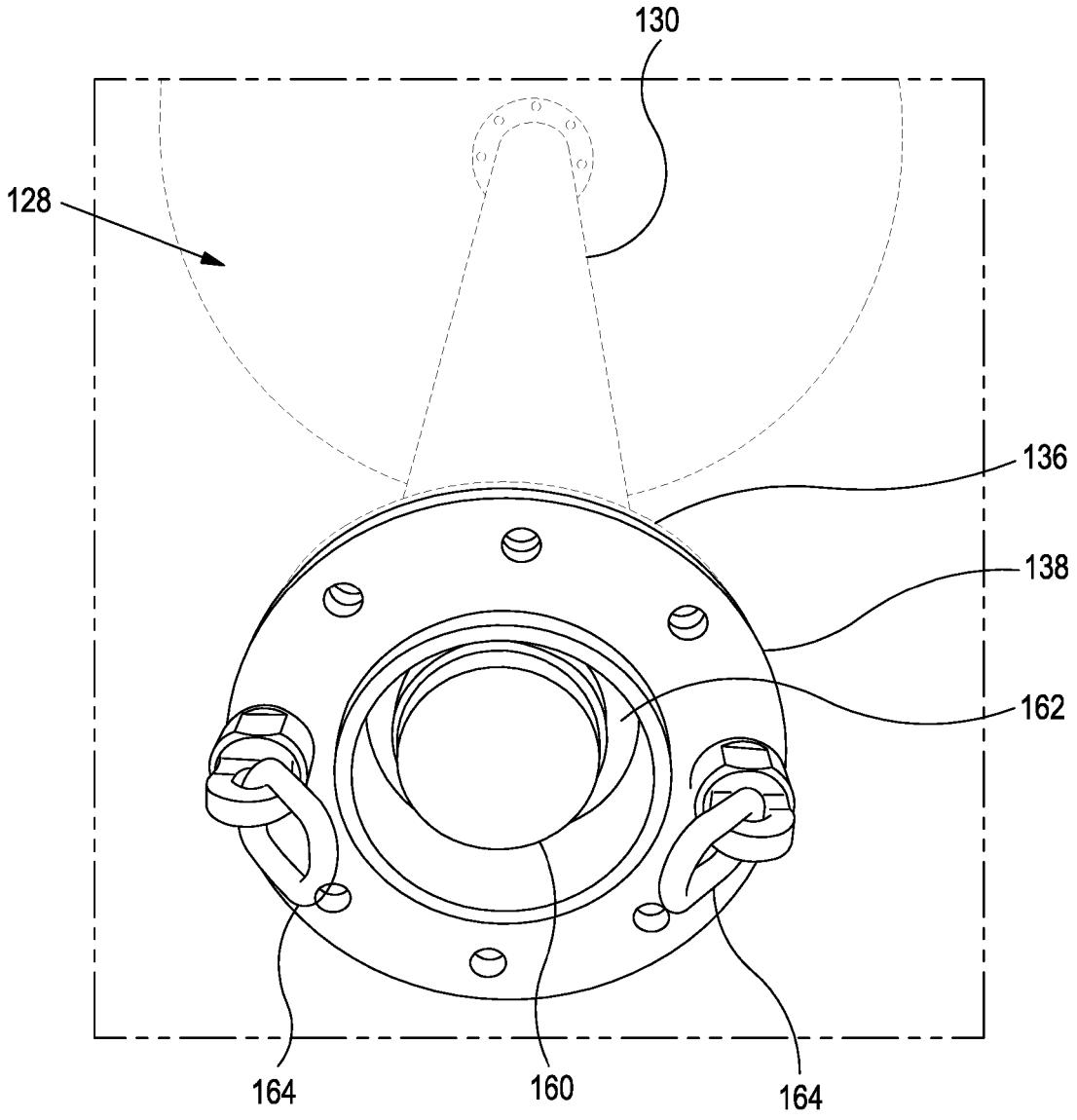
FIG. 7 is an enlarged perspective view of a portion of the second end of the inflatable vessel of FIG. 2.

One or more connectors, such as shackles 164 shown in FIGS. 3 and 7, may be used to connect the second reinforcing ring 138 to an object or structure. In an alternative embodiment, the components at the second end of the rigid elongate member may be arranged as described above for the first end, that is having a portion of the second end of the rigid elongate member extend through the membrane 120 and beyond the surface of the membrane, in an analogous manner to that shown in FIG. 5.

Figure 6:
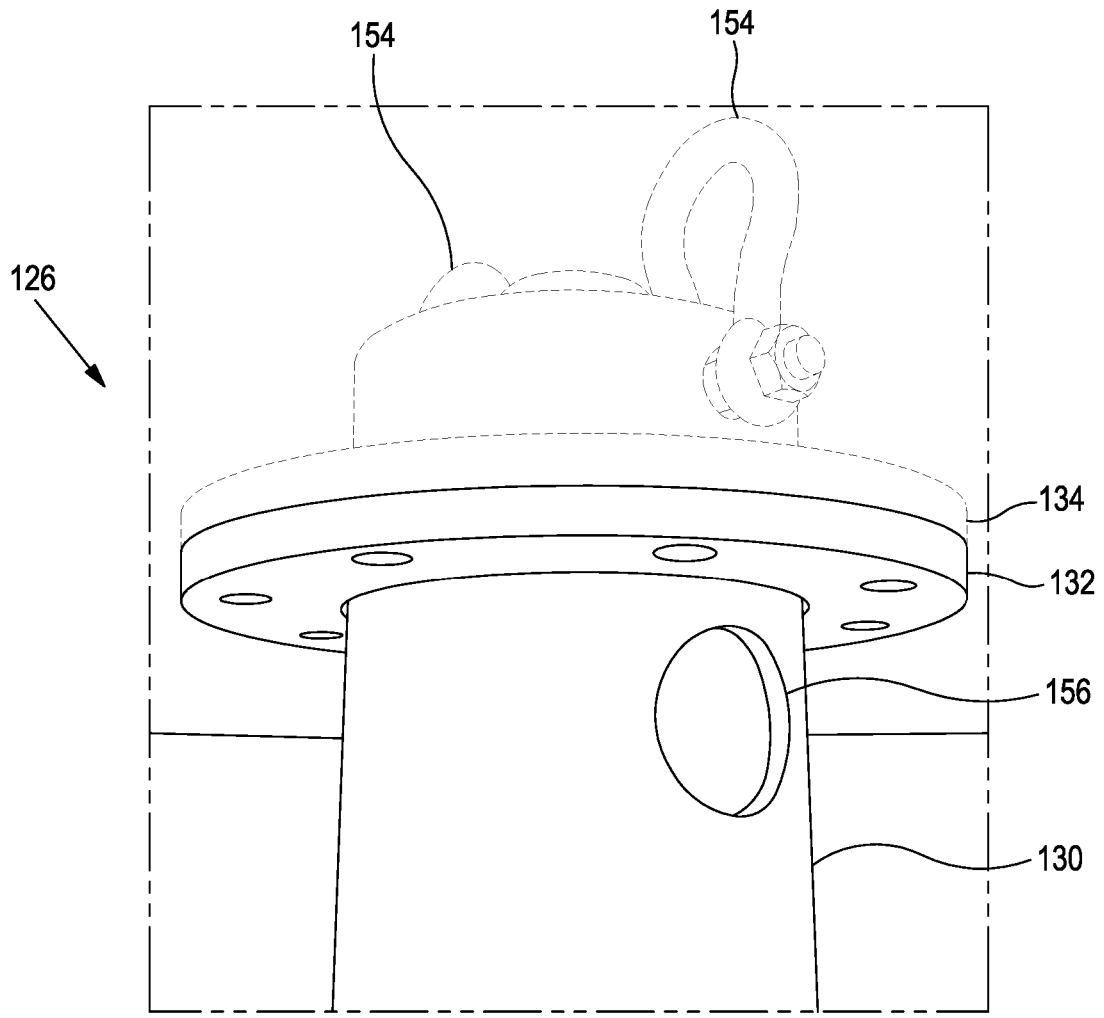
FIG. 6 is an enlarged perspective view of a portion of the first end of the rigid elongate member of the vessel of FIG. 2.

Turning to FIGS. 5 and 6, a first fluid port 150 is located in a first bulkhead 152 at the first end of the rigid elongate member 130. The first fluid port 150 is shown with a camlock fitting **150*a* for connecting to a compressor or pump manifold. The rigid elongate member is further provided with a second fluid port 156 opening into the interior of the membrane 120, as can be seen in FIG. 6. The interior of the rigid elongate member 130 forms a fluid conduit between the first fluid port 150, the second fluid port 156 and the interior of the flexible membrane, through which fluid can be delivered or extracted from the interior of the flexible membrane to inflate and deflate the inflatable vessel 110** as required.

Referring to FIG. 7 there is shown an enlarged perspective view of the second attachment point 128 of the inflatable vessel of FIG. 3, as viewed from the exterior of the flexible membrane. The second end of the rigid elongate member is closed by a second bulkhead 162 to provide a fluid-tight seal. A pressure release valve 160 is located in the second bulkhead 162. The interior of the rigid elongate member 130 forms a fluid conduit between the interior of the flexible membrane and the pressure release valve through which excess fluid pressure can be vented.

Figure 8:
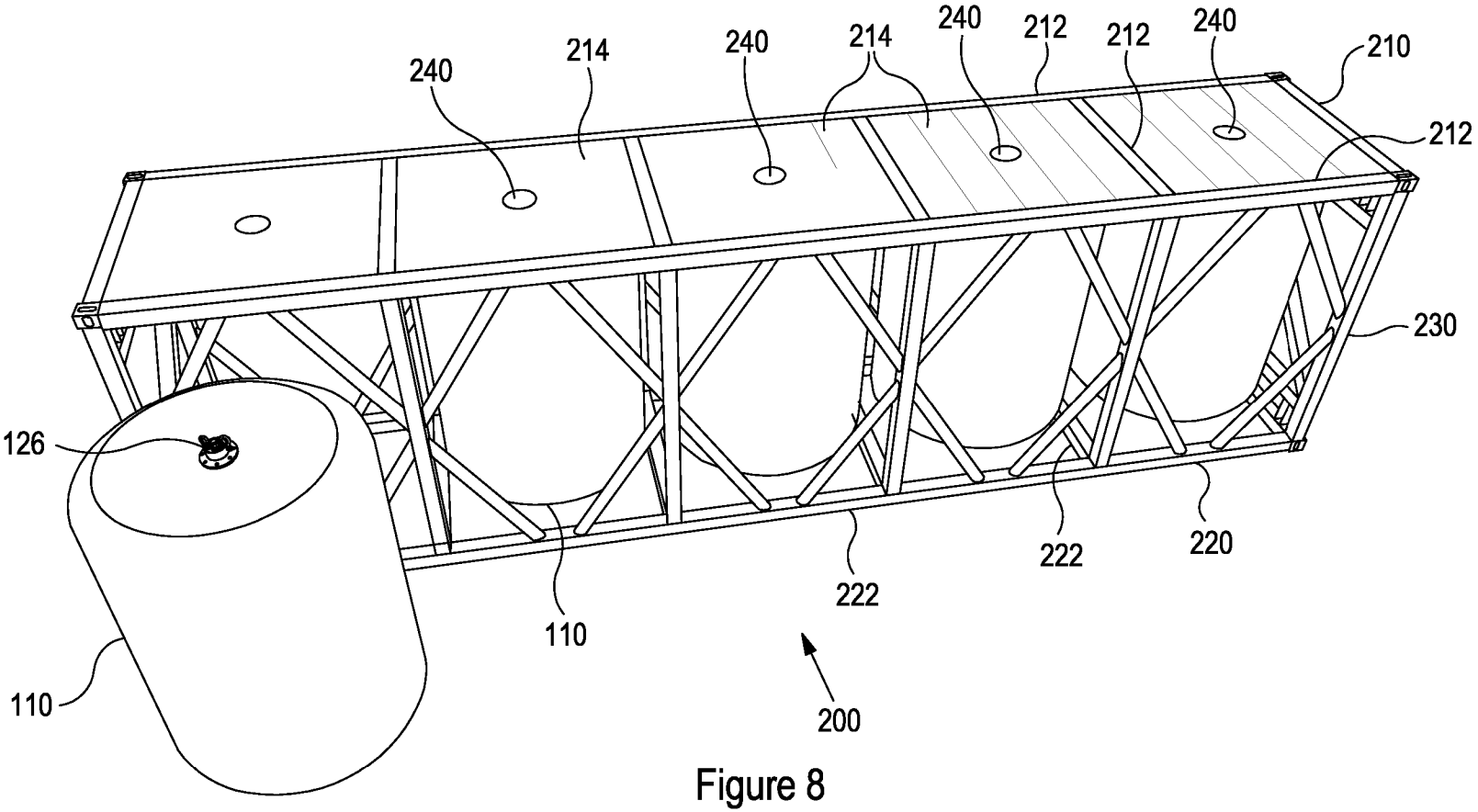
FIG. 8 is a perspective view of a floating deck assembly including a plurality of inflatable vessels according to the present invention.

FIG. 8 is a perspective view of a floating assembly, specifically a floating deck assembly 200, including a plurality of inflatable vessels 110 according to the present invention. The floating assembly includes a first frame assembly 210 and a second frame assembly 220. The first frame assembly 210 includes a plurality of first frame members 212 interconnected to form a latticework defining a plurality of unit cells. The first frame assembly 210 further includes a plurality of deck panels 214. Each deck panel is located within a unit cell of the latticework of frame members 212. The second frame assembly 220 includes a plurality of second frame members 222. A plurality of support members 230 extends between and connects the first frame assembly 210 and the second frame assembly 220.

A plurality of inflatable vessels 110 according to the present invention are disposed between the first frame assembly 210 and the second frame assembly 220 in use. Each inflatable vessel 110 is connected to the first frame assembly at its first attachment point 126. In particular, the first attachment point of each inflatable vessel is connected to a respective deck panel 214, at a connection 240, as will be described in more detail below.

Figure 9:
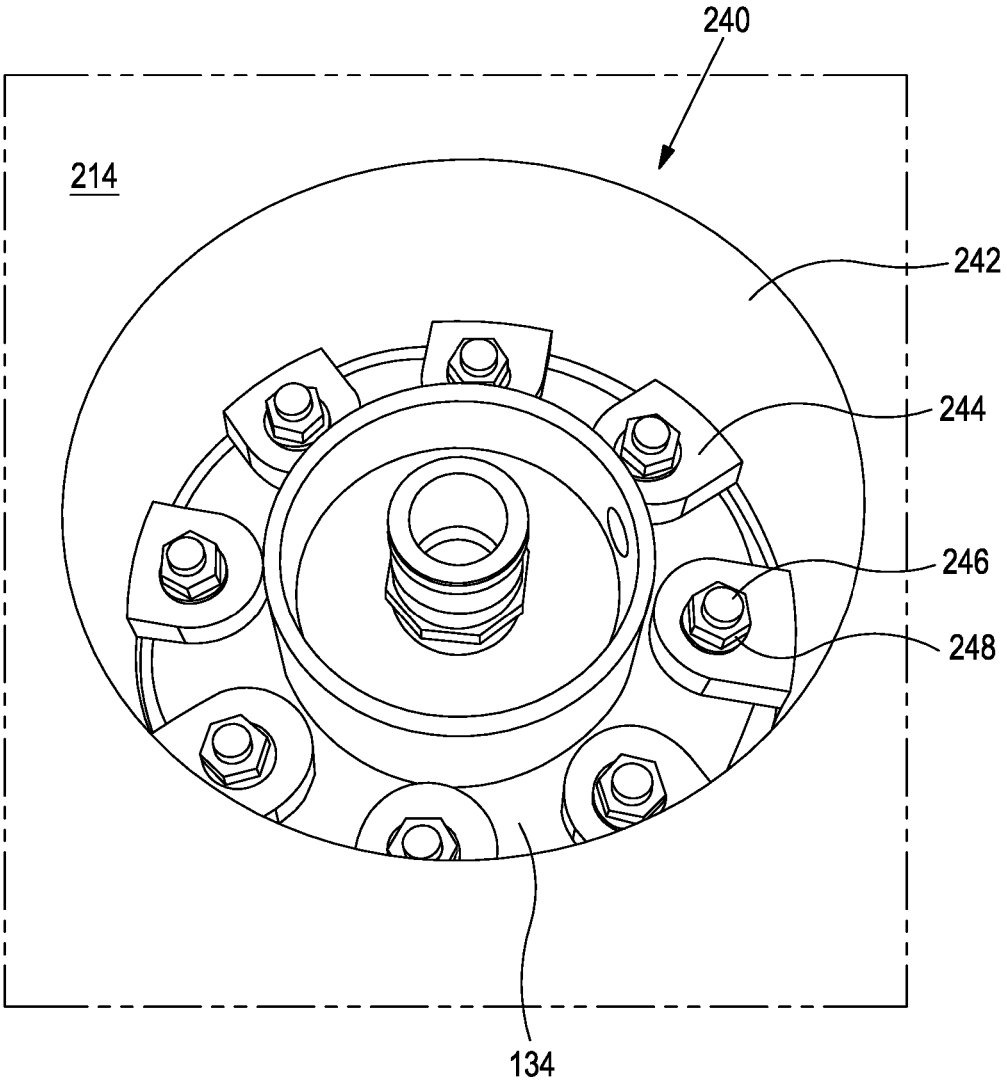
FIG. 9 is an enlarged view of a connection of the floating deck assembly of FIG. 8.

FIG. 9 is an enlarged perspective view of a connection 240 in a deck panel 214. The connection includes an aperture 242 in the deck panel for locating the first reinforcing ring 134 of the vessel 110. Additional components located at the first end of the rigid elongate member, including the first fluid port 150 are visible and accessible via the aperture 242.

A plurality of connecting plates 244 extend radially into the aperture 242. Each connecting plate is provided with an aperture for receiving one of a plurality of bolts 246, which extend through the first flange, the flexible membrane and first reinforcing ring at the first attachment point. The bolts 246 are each secured with a nut 248.

The buoyancy of the inflatable vessel is transferred to the deck panel 214 at the connection 240.

Figure 10:
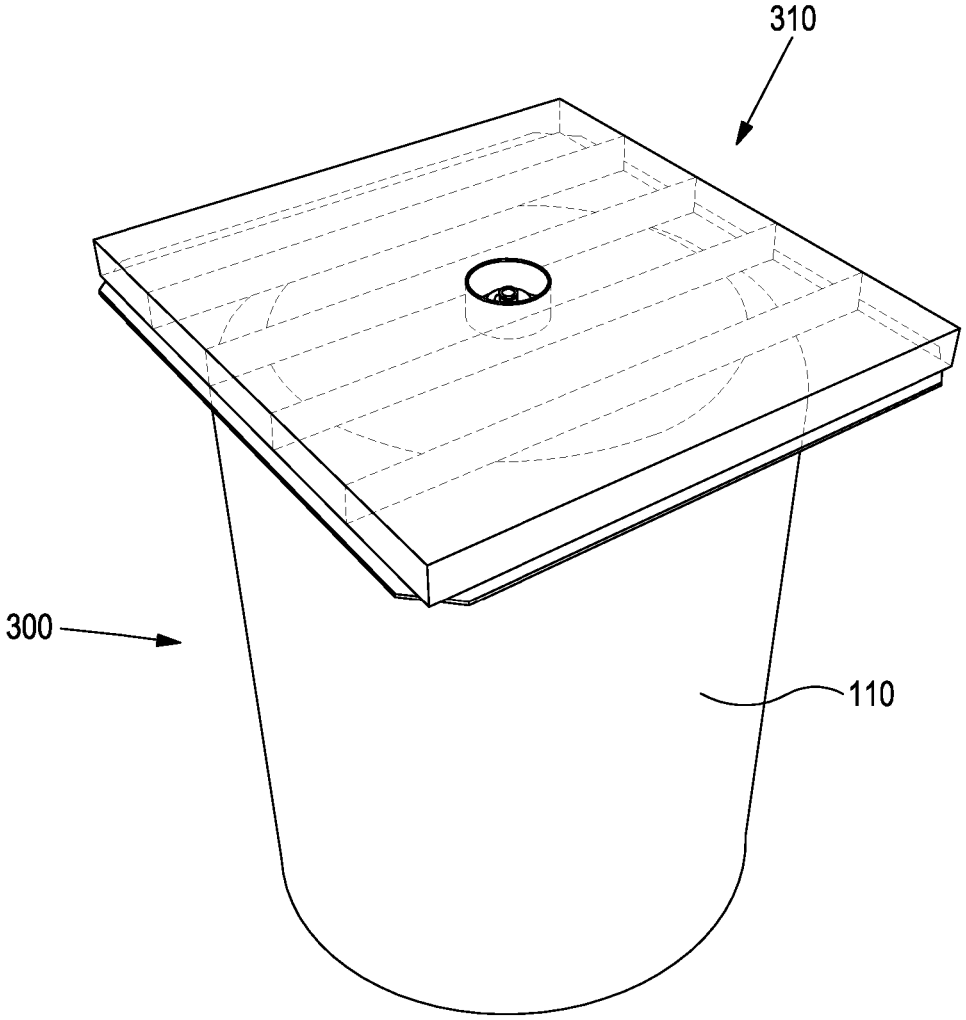
FIG. 10 is a perspective view of a floating deck unit according to an embodiment of the present invention.

FIG. 10 shows a floating deck unit 300 according to a further embodiment of the present invention. The floating deck unit 300 comprises an inflatable vessel 110, as shown in FIG. 2. A deck panel 310 is mounted to the first end of the vessel 110 in an analogous manner to that shown in FIG. 9 and described above. The deck panel 310 is a sealed box construction that remains slightly buoyant, even when the inflatable vessel is fully deflated. This helps the unit to remain upright, with the rigid elongate member of the inflatable vessel orientated vertically, in use.

Figure 11:
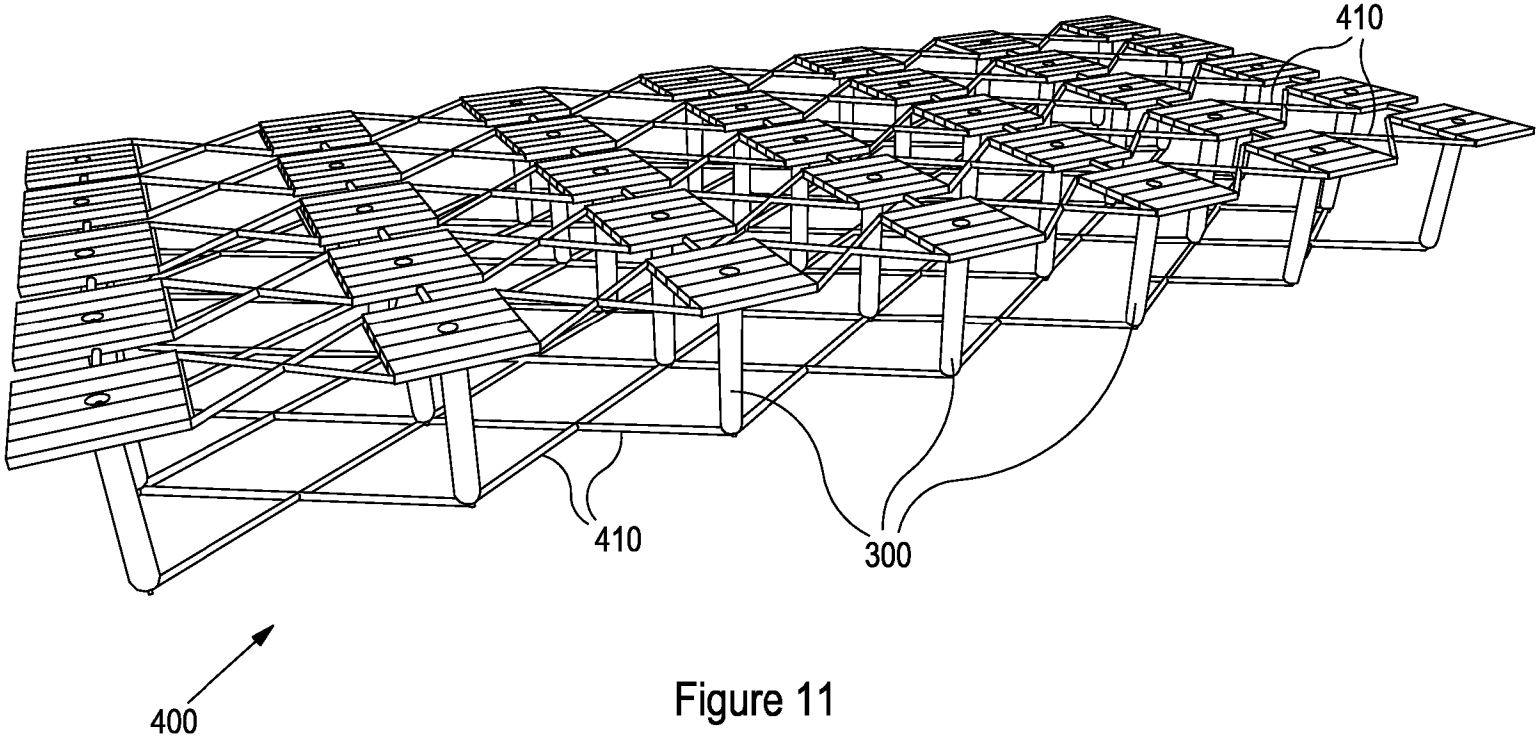
FIG. 11 is a perspective view of a still further embodiment of a floating deck assembly of the present invention.

FIG. 11 shows a plurality of floating deck units 300, as shown in FIG. 10, tethered together in a modular arrangement to form a floating deck assembly 400. The flexible membrane of each inflatable vessel is shown in a deflated state. Each deck unit 300 is tethered to each adjacent assembly by connecting members 410. The connecting members may be rigid, such as bars, rods or tubes, or may be flexible, such as cables.

Figure 12:
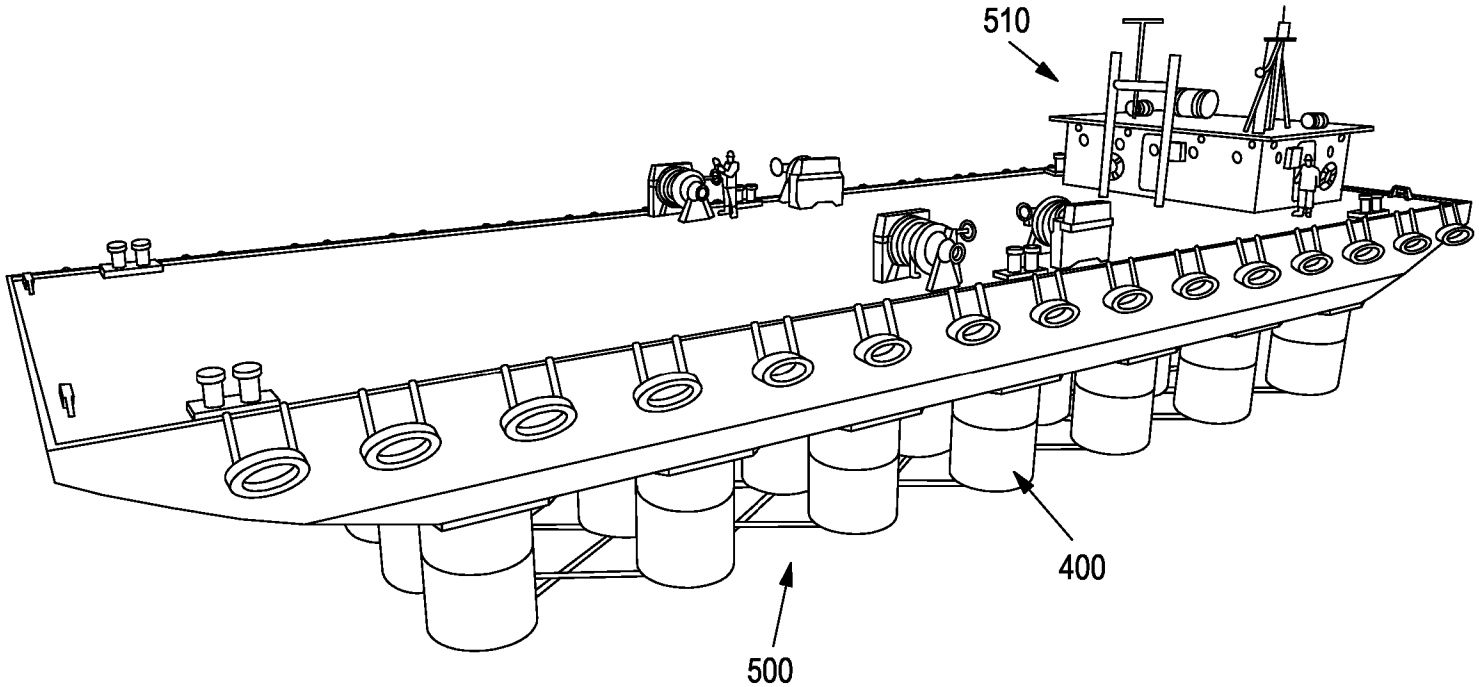
FIG. 12 is a perspective view of a floating dry dock assembly of the present invention.

Referring to FIG. 12, there is shown a floating dry dock assembly, generally indicated as 500. The floating dry dock assembly comprises a floating deck assembly 400 as shown in FIG. 11, positioned beneath a ship 510.

Figure 13:
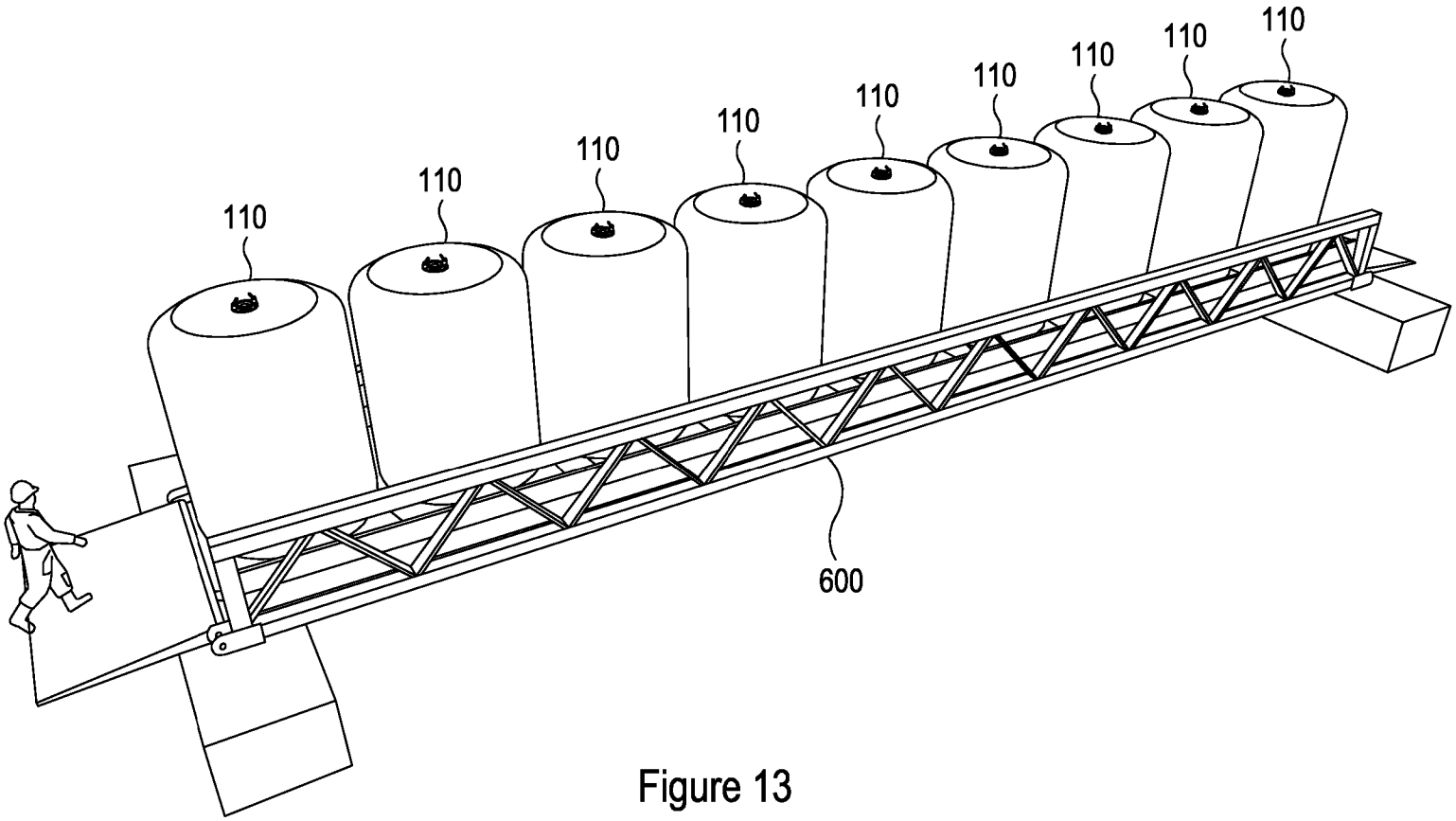
FIG. 13 is a perspective view of a plurality of inflatable vessels according to the present invention disposed on a bridge.

Finally, FIG. 13 shows a plurality of inflatable vessels 110 according to the present invention, inverted and disposed on a bridge 600. The inflatable vessels are filled with a liquid, for example water, to weight test the bridge.

The invention claimed is:

1. An inflatable vessel comprising:

an enclosed flexible membrane having an interior, a first end and a second end; and a rigid elongate member extending within the interior of the membrane and attached to the membrane at a first attachment point at the first end of the membrane and to the membrane at a second attachment point at the second end of the membrane; and a pressure relief system to allow excess fluid pressure within the vessel to be vented, the pressure relief system comprising a pressure relief valve;

wherein the rigid elongate member further comprises a fluid port and the rigid elongate member comprises a fluid conduit for fluid to pass between the fluid port and the interior of the flexible membrane; and wherein the pressure relief system is connected to the rigid elongate member.

2. The inflatable vessel according to claim 1, wherein the rigid elongate member is attached to the membrane at the first attachment point by a first attachment member located at or adjacent a first end of the rigid elongate member.

3. The inflatable vessel according to claim 2, wherein the rigid elongate member is attached to the membrane at the second attachment point by a second attachment member located at or adjacent a second end of the rigid elongate member.

4. The inflatable vessel according to claim 3, wherein the first attachment member and/or the second attachment member comprises a plate, collar or flange.

5. The inflatable vessel according to claim 1, wherein the membrane is reinforced by a reinforcement in the region of the first attachment point and/or the second attachment point.

6. The inflatable vessel according to claim 5, wherein one or both of the reinforcements comprises a reinforcing member disposed on the inside or outside of the membrane.

7. The inflatable vessel according to claim 6, wherein one or both of the reinforcing members comprises a reinforcing ring.

8. The inflatable vessel according to claim 1, wherein one or more portions of the rigid elongate member extends through and outside the membrane.

9. The inflatable vessel according to claim 8, wherein an end portion of the rigid elongate member extends through the membrane at the first attachment point and/or the second attachment point.

10. The inflatable vessel according to claim 1, further comprising one or more connectors located at one or both of the first and second attachment points for connecting the inflatable vessel to an external structure.

11. The inflatable vessel according to claim 1, wherein at least a portion of the rigid elongate member is hollow.

12. The inflatable vessel according to claim 1, wherein the rigid elongate member comprises a tube.

13. The inflatable vessel according to claim 1, wherein the pressure relief valve is provided in the rigid elongate member.

14. The inflatable vessel according to claim 1, wherein the rigid elongate member further comprises one or more outlet tubes for emitting fluid from the rigid elongate member beyond the first and/or second attachment point.

15. A floating assembly comprising at least one inflatable vessel according to claim 1.

16. The floating assembly according to claim 15, the assembly comprising:

a first frame assembly;

a second frame assembly;

a plurality of support members extending between and connecting the first frame assembly and the second frame assembly; and a plurality of inflatable vessels disposed between the first frame assembly and the second frame assembly.

17. The floating assembly according to claim 16, wherein each inflatable vessel is connected to the first frame assembly at the first attachment point for transferring the buoyancy of the inflatable vessel to the first frame assembly and/or to the second frame assembly at the second attachment point for transferring the buoyancy of the inflatable vessel to the second frame assembly.

18. The floating assembly according to claim 16, further comprising:

one or more deck panels forming a deck connected to the first frame assembly.

19. A floating dry dock comprising the floating assembly according to claim 18.

* * * * *